US011285977B2

(12) United States Patent
Fege et al.

(10) Patent No.: US 11,285,977 B2
(45) Date of Patent: Mar. 29, 2022

(54) RAIL VEHICLE

(71) Applicant: SIEMENS MOBILITY GMBH, Munich (DE)

(72) Inventors: Alexander Fege, Augsburg (DE); Hannes Peer, Munich (DE)

(73) Assignee: Siemens Mobility GmbH, Munich (DE)

( * ) Notice: Subject to any disclaimer, the term of this patent is extended or adjusted under 35 U.S.C. 154(b) by 157 days.

(21) Appl. No.: 16/641,760

(22) PCT Filed: Jun. 11, 2018

(86) PCT No.: PCT/EP2018/065282
§ 371 (c)(1),
(2) Date: Feb. 25, 2020

(87) PCT Pub. No.: WO2019/037914
PCT Pub. Date: Feb. 28, 2019

(65) Prior Publication Data

US 2020/0391770 A1 Dec. 17, 2020

(30) Foreign Application Priority Data

Aug. 25, 2017 (DE) ..... 102017214925.6

(51) Int. Cl.
*B61D 17/12* (2006.01)

(52) U.S. Cl.
CPC ..... *B61D 17/12* (2013.01)

(58) Field of Classification Search
CPC .... B61D 17/00; B61D 17/043; B61D 17/045; B61D 17/046; B61D 17/08; B61D 17/12
See application file for complete search history.

(56) References Cited

U.S. PATENT DOCUMENTS 3,025,933 A * 3/1962 Comino ..... A47B 96/1408 403/3
3,131,649 A * 5/1964 Eggert, Jr. ..... B61D 17/043 105/401
5,355,806 A * 10/1994 Bieber ..... B60J 1/007 105/26.05
5,943,958 A 8/1999 Hofmann et al.
(Continued)

FOREIGN PATENT DOCUMENTS

CN 202624233 U 12/2012
CN 203753026 U 8/2014
(Continued)

*Primary Examiner* — Mark T Le
(74) *Attorney, Agent, or Firm* — Laurence A. Greenberg; Werner H. Stemer; Ralph E. Locher

(57) ABSTRACT

A rail vehicle contains a roof, a securing device, and a body. The securing device has at least a first securing unit and at least a second securing unit, and the first securing unit and the second securing unit are arranged offset relative to each other and are configured to secure the roof to the body. The first securing unit contains a fixed bearing, the fixed bearing is configured to prevent a movement of the roof relative to the body, and the second securing unit has a floating bearing, the floating bearing is configured to allow a movement of the roof in a longitudinal direction of the rail vehicle and to prevent a movement of the roof perpendicularly to the vehicle longitudinal direction.

14 Claims, 8 Drawing Sheets

(56) References Cited

U.S. PATENT DOCUMENTS

| | | | | |
|---|---|---|---|---|
| 5,988,074 | A | 11/1999 | Thoman | |
| 6,454,345 | B1 * | 9/2002 | Campus | B61D 17/045 296/203.01 |
| 6,805,523 | B2 * | 10/2004 | Burke | B60P 3/08 410/117 |
| 7,784,150 | B2 * | 8/2010 | Anderson | F16B 43/00 16/2.1 |
| 2008/0093472 | A1 | 4/2008 | Hohne et al. | |
| 2009/0008522 | A1 * | 1/2009 | Mitterbacher | E04F 13/0808 248/231.91 |
| 2014/0097218 | A1 | 4/2014 | Bittner | |
| 2015/0307113 | A1 | 10/2015 | Claassen et al. | |
| 2016/0207545 | A1 * | 7/2016 | Kammler | B61D 17/12 |

FOREIGN PATENT DOCUMENTS

| | | | |
|---|---|---|---|
| CN | 204895469 | U | 12/2015 |
| CN | 205113340 | U | 3/2016 |
| CN | 205652131 | U | 10/2016 |
| DE | 4244155 | A1 | 6/1994 |
| DE | 29512123 | U1 | 11/1996 |
| DE | 102012007318 | A1 | 10/2013 |
| FR | 885447 | A | 9/1943 |
| JP | 2017140967 | A | 8/2017 |
| KR | 101019923 | B1 | 3/2011 |
| SU | 1106710 | A | 8/1984 |

* cited by examiner

RAIL VEHICLE

BACKGROUND OF THE INVENTION

Field of the Invention

The invention relates to a rail vehicle as claimed in the independent patent claim.

Rail vehicles having a roof and a car body, wherein the roof is disposed on the car body, are known. The car body and the roof delimit a vehicle interior space. The roof is exposed to high thermal loads. Should the roof and the car body comprise dissimilar materials, stresses by virtue of a dissimilar thermal expansion behavior of the materials arise between the roof and the car body.

SUMMARY OF THE INVENTION

It is an object of the invention to provide an improved rail vehicle.

This object is achieved by means of a rail vehicle as claimed in the independent patent claim. Advantageous embodiments are set forth in the dependent claims.

It has been recognized that an improved rail vehicle can be provided in that the rail vehicle has a roof, a fastening installation, and a car body, wherein the fastening installation has at least one first fastening unit and at least one second fastening unit. The first fastening unit and the second fastening unit are disposed so as to be mutually offset and configured so as to fasten the roof to the car body. The first fastening unit has a fixed bearing, wherein the fixed bearing is configured for preventing a movement of the roof relative to the car body. The second fastening unit has a floating bearing, wherein the floating bearing is configured for permitting a movement of the roof in a vehicle longitudinal direction of the rail vehicle, and for preventing a movement of the roof perpendicular to the vehicle longitudinal direction.

This design embodiment has the advantage that the roof can be reliably fastened to the car body, on the one hand, and the materials for the car body and for the roof can be selected in a mutually independent manner, on the other hand, since a longitudinal compensation between the roof and the car body is provided by the floating bearing.

In one further embodiment, the roof has at least one roof segment, wherein the roof segment in the vehicle longitudinal direction covers a sub-region of the rail vehicle, and in the transverse direction extends across an entire vehicle width of the rail vehicle, wherein the car body has a first car body portion and a second car body portion, wherein the first car body portion and the second car body portion extend so as to be parallel with the vehicle longitudinal direction, and are disposed so as to be mutually offset in the transverse direction, wherein the roof segment is connected to the first car body portion exclusively by way of only one first fastening unit, and is connected to the second car body portion exclusively by way of only one further fastening unit, wherein the two first fastening units are configured so as to be mutually identical.

In one further embodiment, the fastening installation has a first row and a second row, wherein each of the rows has in each case a plurality of second fastening units and exclusively precisely one first fastening unit, wherein the first row fastens the roof segment to the first car body portion, and the second row fastens the roof segment to the second car body portion. A movement of the roof relative to the car body can be enabled by providing exclusively one fastening unit per row, and the roof can simultaneously be reliably fastened to the car body by providing further second fastening units.

In one further embodiment, the first fastening units are in each case disposed in a first plane, wherein the first plane is aligned so as to be perpendicular to the vehicle longitudinal direction of the rail vehicle. The second fastening units are in each case disposed in a second plane which is disposed so as to be perpendicular to the vehicle longitudinal direction of the rail vehicle, wherein the first plane in relation to the second plane is disposed so as to be offset in the vehicle longitudinal direction.

In one further embodiment, the roof has a first through opening, wherein the fixed bearing has a fastening element having a penetrating portion which is configured in the manner of a stud, and a connecting portion, wherein the connecting portion is connected to the penetrating portion, wherein the connecting portion on a side that faces away from the penetrating portion is connected to the car body, wherein the penetrating portion penetrates the first through opening, wherein the first through opening and an external circumferential face of the penetrating portion are configured so as to be substantially without a mutual gap, wherein the roof bears on the connecting portion. On account thereof, the position of the roof relative to the car body is reliably established, and a particularly cost-effective fixed bearing of simple configuration is configured.

In one further embodiment, the fixed bearing has a force-fitting connection, in particular a screw connection, and a first fastening rail. The first fastening rail on the lower side is connected to the car body, wherein the force-fitting connection engages in portions in the first fastening rail and pushes the roof against the first fastening rail.

In one further embodiment, the floating bearing comprises a fastening sleeve and a further force-fitting connection having a screw nut and a screw. The roof has a second through opening. The screw at one side is coupled to the car body, and at the opposite side the screw nut is screwed onto the screw about a screw axis of the screw. The fastening sleeve is disposed between the screw nut and the car body, and has a first sleeve portion, a second sleeve portion which in terms of the screw axis is axially contiguous to the first sleeve portion, and a third through opening. The second sleeve portion in terms of the screw axis has a larger radial extent than the first sleeve portion. The screw penetrates the third through opening, and the first sleeve portion engages in the second through opening. The second sleeve portion is disposed between the screw nut and the roof and, by way of the roof impacting on the second sleeve portion, prevents a movement of the roof away from the car body.

In one further embodiment, the third through opening is disposed so as to be centric in relation to the second sleeve portion. The first sleeve portion is disposed so as to be eccentric in relation to the third sleeve portion. On account thereof, production tolerances can be compensated for when assembling the roof.

In one further embodiment, the third through opening is configured in the manner of an elongate hole, wherein the third through opening in the direction of wider extent thereof extends transversely to the vehicle longitudinal direction. On account thereof, production tolerances can be compensated for when assembling the roof.

In one further embodiment, the second fastening unit has a fastening rail, wherein the fastening rail by way of a lower side is fastened to the car body on the upper side, wherein a screw head of the screw engages in the fastening rail, wherein the fastening sleeve is braced between the fastening rail and the screw nut, and the first sleeve portion at the face side bears on an upper side of the fastening rail. The second sleeve portion by way of a sleeve lower side holds the roof to the upper side of the second fastening rail.

In one further embodiment, and axial gap is disposed between the roof and a face side of the sleeve portion.

In one further embodiment, an elastic element is disposed between a face side of the second sleeve portion and the roof, wherein the elastic element is configured so as to be disk-shaped and encompasses circumferentially the first sleeve portion. The elastic element preferably comprises one of the following materials: rubber, silicone, natural rubber.

In one further embodiment, the roof segment has a roof portion and a fastening portion, wherein the roof portion extends between the two car body portions and conjointly with the car body portions delimits a vehicle interior space. The fastening portion is disposed so as to be laterally contiguous to the roof portion and is connected to the roof portion and extends from the vehicle interior space away toward the outside. The fastening portion is configured so as to be plate-shaped, and the second through opening is disposed in the fastening portion. The fastening portion on the lower side bears on the upper side of the second fastening rail. The fastening portion is disposed between the upper side of the second fastening rail and the second sleeve portion.

DETAILED DESCRIPTION OF THE INVENTION

In the figures hereunder, reference will be made to a coordinate system 5. The coordinate system 5 herein has an x-axis (vehicle longitudinal direction 15), a y-axis (transverse direction), and a z-axis (vertical direction). The coordinate system 5 in an exemplary manner is configured as a right-handed system. The coordinate system 5 is intended to serve for improved understanding.

Figure 1:
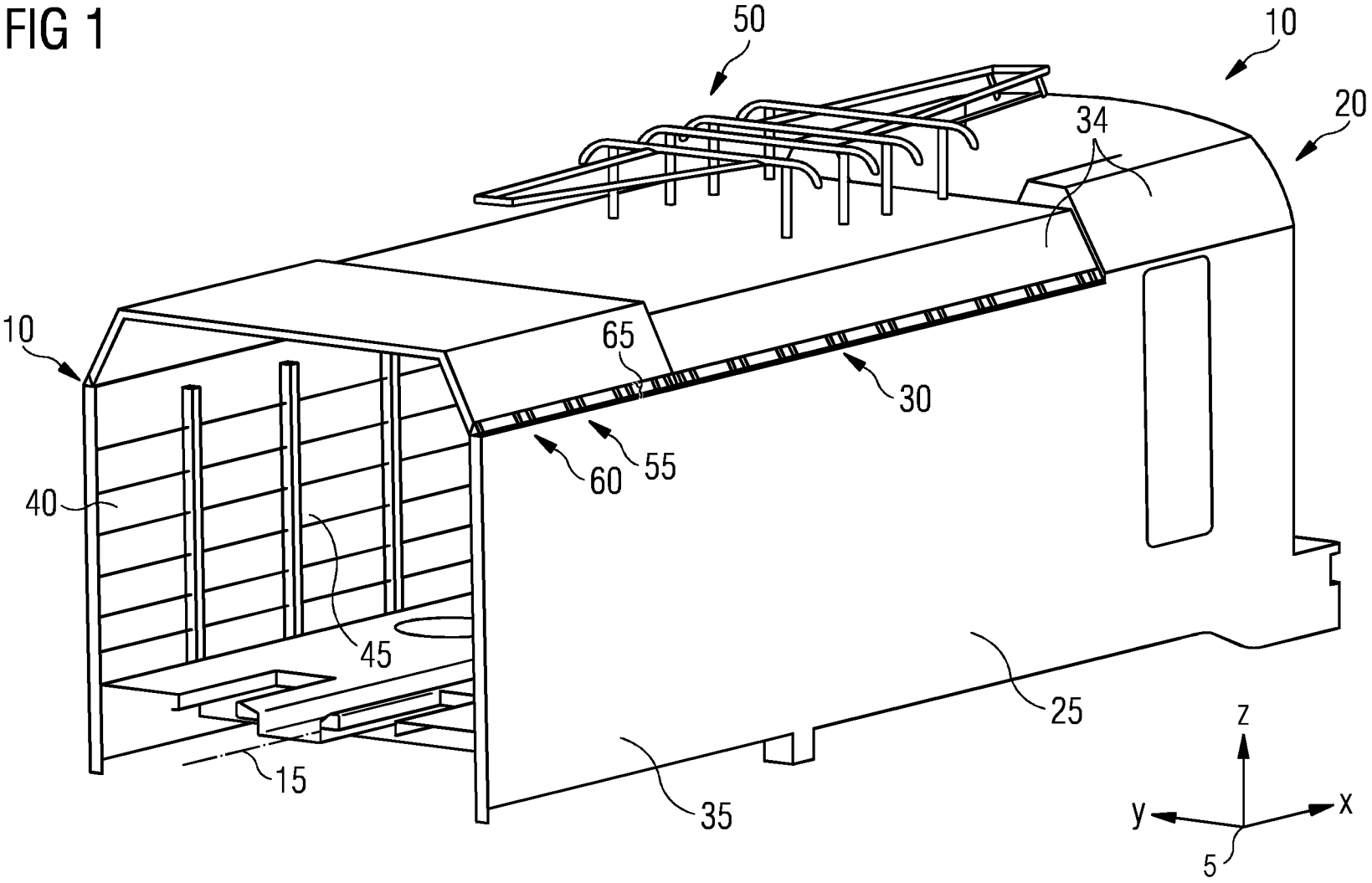
FIG. 1 shows a perspective cross section through a rail vehicle according to a first embodiment.

FIG. 1 shows a perspective cross section through a rail vehicle 10.

The rail vehicle 10 in an exemplary manner is configured as a locomotive. Of course, the rail vehicle 10 may also be configured differently, in particular as a rail car, for example.

The rail vehicle 10 is displaced in the vehicle longitudinal direction 15 along a rail track (not illustrated in FIG. 1). The vehicle longitudinal direction 15 is aligned so as to be parallel with the x-axis of the coordinate system 5.

The rail vehicle 10 furthermore has a roof 20, a car body 25, and a fastening installation 30. The roof 20 in the embodiment in an exemplary manner has a plurality of roof segments 34, wherein the roof segments 34 in the vehicle longitudinal direction 15 are fastened in sequence to the car body 25 by means of the fastening installation 30. The number of roof segments 34 is exemplary and can be freely chosen. Of course, another number of roof segments 34 is also conceivable. It is in particular also conceivable that only one roof segment 34 is exclusively fastened to the car body 25.

The car body 25 has at least one first car body portion 35 which extends in the vehicle longitudinal direction 15, and one second car body portion 40 which extends in the vehicle longitudinal direction 15. The first car body portion 35 and the second car body portion 40 are disposed so as to be offset in the transverse direction, that is to say offset perpendicularly to the vehicle longitudinal direction 15. The first car body portion 35 and the second car body portion 40 herein laterally delimit a vehicle interior space 45 of the rail vehicle 10. In the embodiment, the first car body portion 35 and the second car body portion 40 are in each case disposed so as to be contiguous to a vehicle side of the rail vehicle 10.

Approximately four to five roof segments 34 are usually provided for a rail vehicle 10 configured as a locomotive. The roof segment 34, by way of the fastening installation 30 on the car body 25, supports mechanical forces, for example mechanical forces of components 50 disposed on the roof 20, for example of a pantograph collector.

Furthermore, the roof segment 34 is exposed to high thermal load such that the roof segment 34 for example in relation to the original state thereof at variable temperatures is expanded or contracted in the vehicle longitudinal direction 15. The roof segment 34 for example is usually made from an aluminum material. The car body 25 supports the roof 20, and usually comprises a steel material. The car body 25 and the roof segment 34, by virtue of the dissimilar materials of the car body 25 and the roof segment 34, have a dissimilar thermal expansion behavior.

The fastening installation 30 has a first fastening unit 55 and at least one second fastening unit 60. The fastening units 55, 60 are in each case on a vehicle side disposed in a first row 65 (the vehicle side facing the observer in FIG. 1) and in a second row 70 (on a side facing away from the observer in FIG. 1). The rows 65, 70 are in each case aligned so as to run mutually parallel and so as to in each case run in the vehicle longitudinal direction 15.

Figure 2:
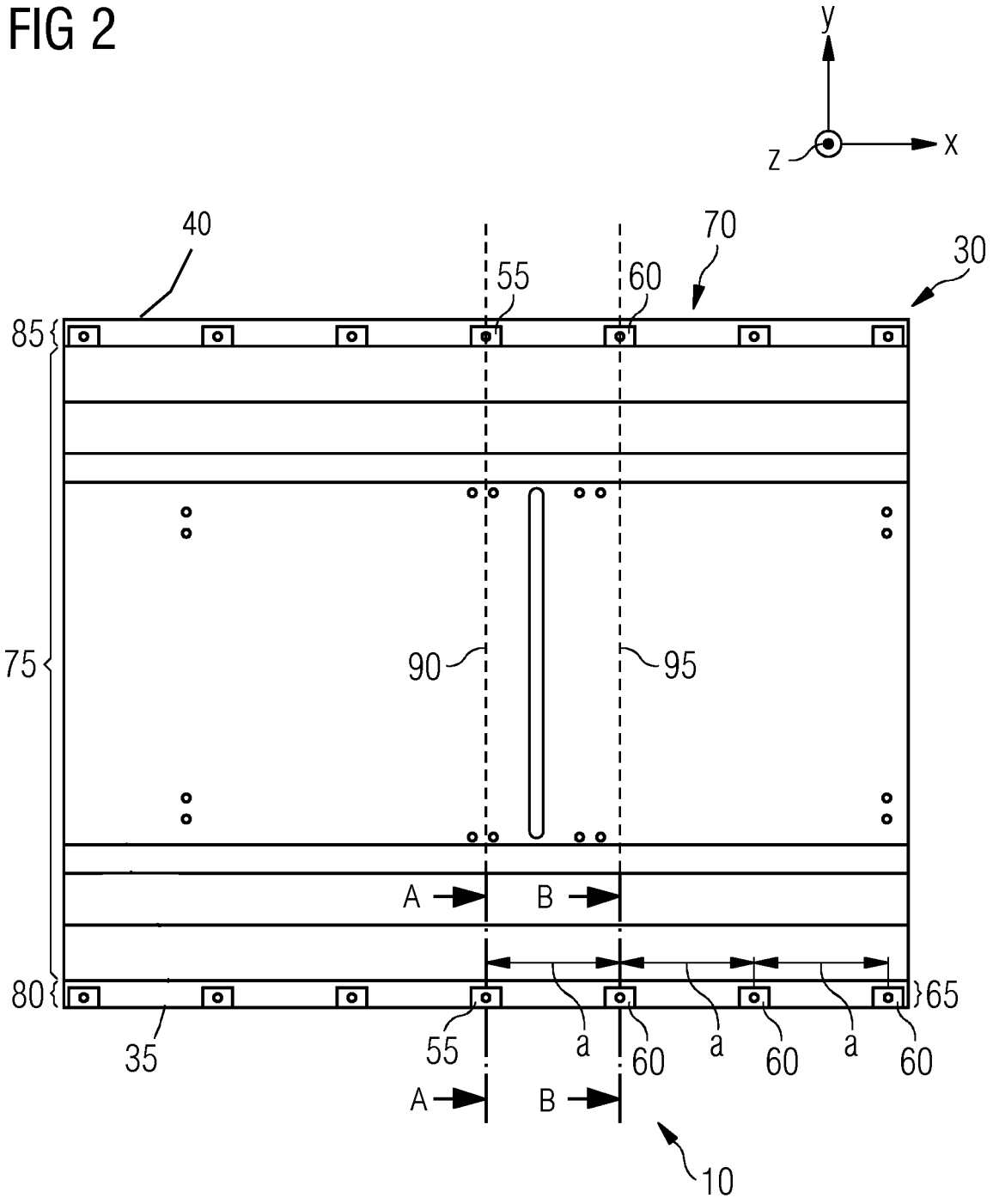
FIG. 2 shows a fragment of a plan view of the rail vehicle shown in FIG. 1.

FIG. 2 shows a fragment of a plan view of the rail vehicle 10 shown in FIG. 1, wherein the illustration of other components not described has been dispensed with for reasons of clarity in FIG. 2.

Each roof segment 34 has a roof portion 75 and at least one fastening portion 80, 85. The fastening portion 80, 85 is fastened laterally to the roof portion 75. The first fastening portion 80 is disposed on the upper side of the first car body portion 35, and the second fastening portion 85 is disposed on the upper side of the second car body portion 40. The roof portion 75 extends between the two car body portion 35, 40, and conjointly with the car body portions 35, 40 delimits the vehicle interior space 45. The fastening portion 80, 85 is connected to the roof portion 75. The roof portion 75 and the fastening portion 85, 85 are preferably configured in one piece and in a materially integral manner.

The fastening portion 80, 85 extends from the vehicle interior space 45 away toward the outside. The fastening portion 80, 85 is configured so as to be plate-shaped. The first row 65 is disposed on the first fastening portion 80, and the second row 70 of the fastening installation 30 is disposed on the second fastening portion 85.

The second row 70 of the fastening installation 30 is configured so as to be identical to the first row 65. The fastening installation 30 in the second row 70 has a further first fastening unit 55 and a multiplicity of further second fastening units 60.

In the embodiment, the first fastening unit 55 of the first row 65 and the further first fastening unit 55 of the second row 70, in a centric position in terms of the vehicle longitudinal direction 15 of the roof segment 34, are disposed in a first plane 90 which extends in the yz-direction and is thus aligned so as to be perpendicular to the vehicle longitudinal direction 15.

A plurality of second fastening units 60 of the first row 65 are preferably disposed at a predefined uniform spacing a on both sides of the first fastening unit 55 of the first row 65. The second fastening unit 60 is disposed in a second plane 95 which is configured as an yz-plane and is thus aligned so as to be perpendicular to the vehicle longitudinal direction 15.

The further second fastening unit 60 is disposed in the second row 70 so as to be offset on both sides in relation to the further first fastening unit 55. The further second fastening unit 60 of the second row 70 is disposed with the second fastening unit 60 of the first row 65 in the second plane 95. On account of the disposal of the second fastening units 60 so as to be opposite in the transverse direction, the further fastening units 55, 60 of the second row 70 thus also have the predefined spacing a.

It is particularly advantageous when only a single first fastening unit 55 is exclusively provided per row 65, 70 of the fastening installation 30. Additionally, the number of second fastening units 60 per row 65, 70 is freely selectable. For example, six second fastening units 60 are in each case provided per roof segment 34 in FIG. 2. However, the number can be chosen so as to be higher or lower, depending on the loading of the roof segment 34.

Also, the first fastening unit 55 and the further first fastening unit 55, instead of being in a centric position, can also be disposed at another position, for example on a face-side end of the roof segment 34.

Figure 3:
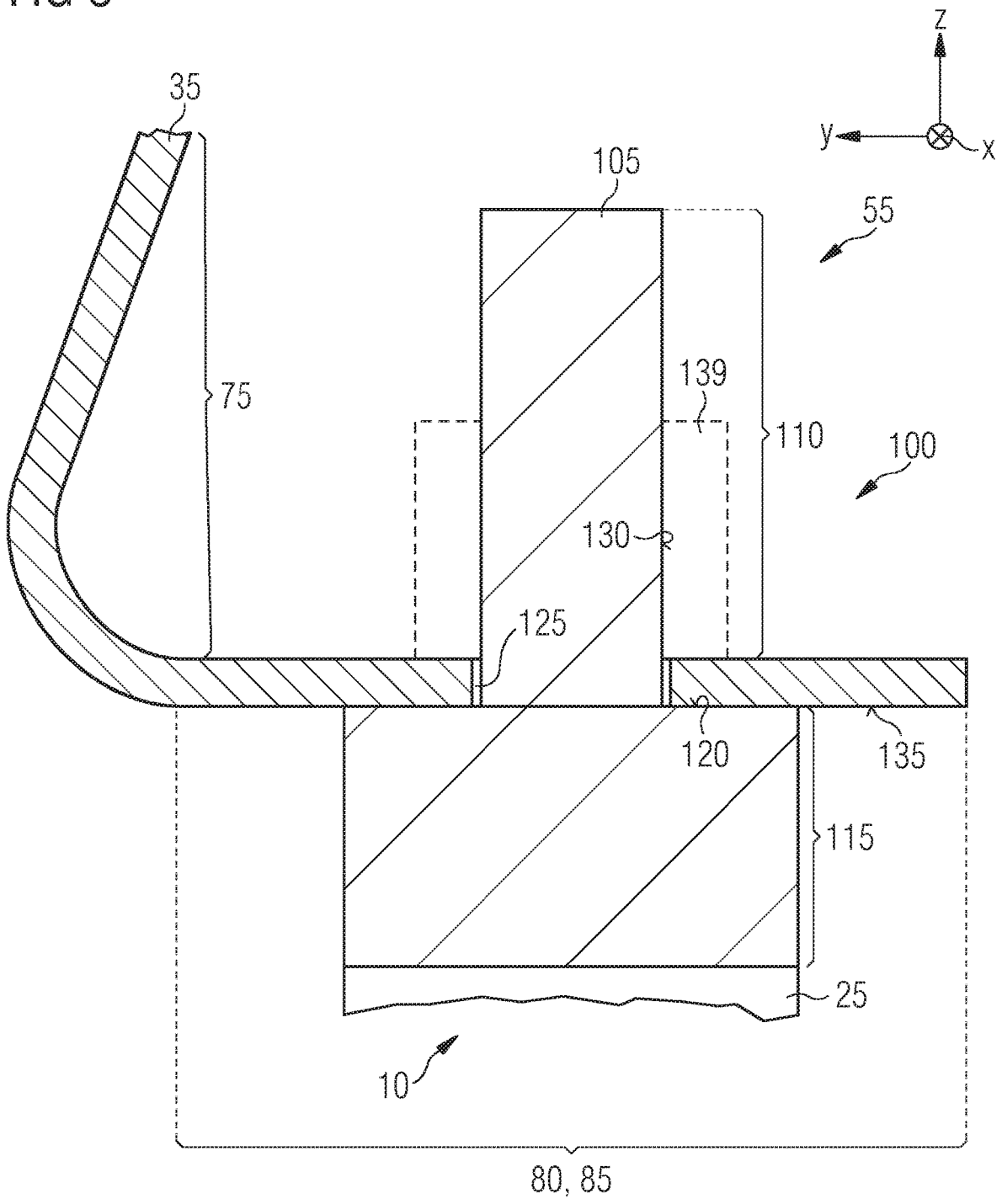
FIG. 3 shows a fragment of a sectional view along a section plane A-A shown in FIG. 2.

FIG. 3 shows a fragment of a sectional view through the rail vehicle 10 along a section plane A-A shown in FIG. 2.

The first fastening unit 55 has a fixed bearing 100. The fixed bearing 100 serves for preventing a relative movement of the roof element 34 relative to the car body 25, and for establishing the position of the roof segment 34 in all spatial directions.

The fixed bearing 100 has a fastening element 105 having a penetrating portion 110 which is configured in the manner of a stud, and a connecting portion 115. The connecting portion 115 is disposed on the upper side of the car body 25 and is connected to the car body 25. For example, the connecting portion 115 can be welded to the car body 25. The connecting portion 115 can also be connected to a fastening rail 140, 141. The connecting portion 115 in the transverse direction is configured so as to be wider than the penetrating portion 110.

The connecting portion 115 on the upper side (on a side facing away from the car body 25) has a bearing face 120. The bearing face 120 is configured so as to be planar, and in an exemplary manner extends in a xy-plane. The penetrating portion 110 is disposed so as to be perpendicular to the bearing face 120. The penetrating portion 110 in an exemplary manner has a circular cross section.

The fastening portion 80, 85 is configured so as to be plate-shaped and has a first through opening 125. The penetrating portion 110 penetrates the first through opening 125. The external circumferential face 130 of the penetrating portion 110 and the first through opening 125 are configured in a mutually corresponding manner such that the first through opening 125 is penetrated by the penetrating portion 110 substantially without a gap. On account thereof, a movement of the roof segment 34 in the x-direction and the y-direction is prevented by the first fastening unit 55, and the roof segment 34 is established in a defined manner in two directions.

The fastening portion 80, 85 by way of a lower side 135 bears in a planar manner on the bearing face 120 such that in the z-direction a position in a direction of the roof segment 34 is established. A fastening means 139 for establishing in a defined manner a position in the z-direction of the roof segment 34 in all spatial directions on the first fastening unit 55 can be provided on the penetrating portion 110, on the upper side of the fastening portion 80, 85.

Figure 4:
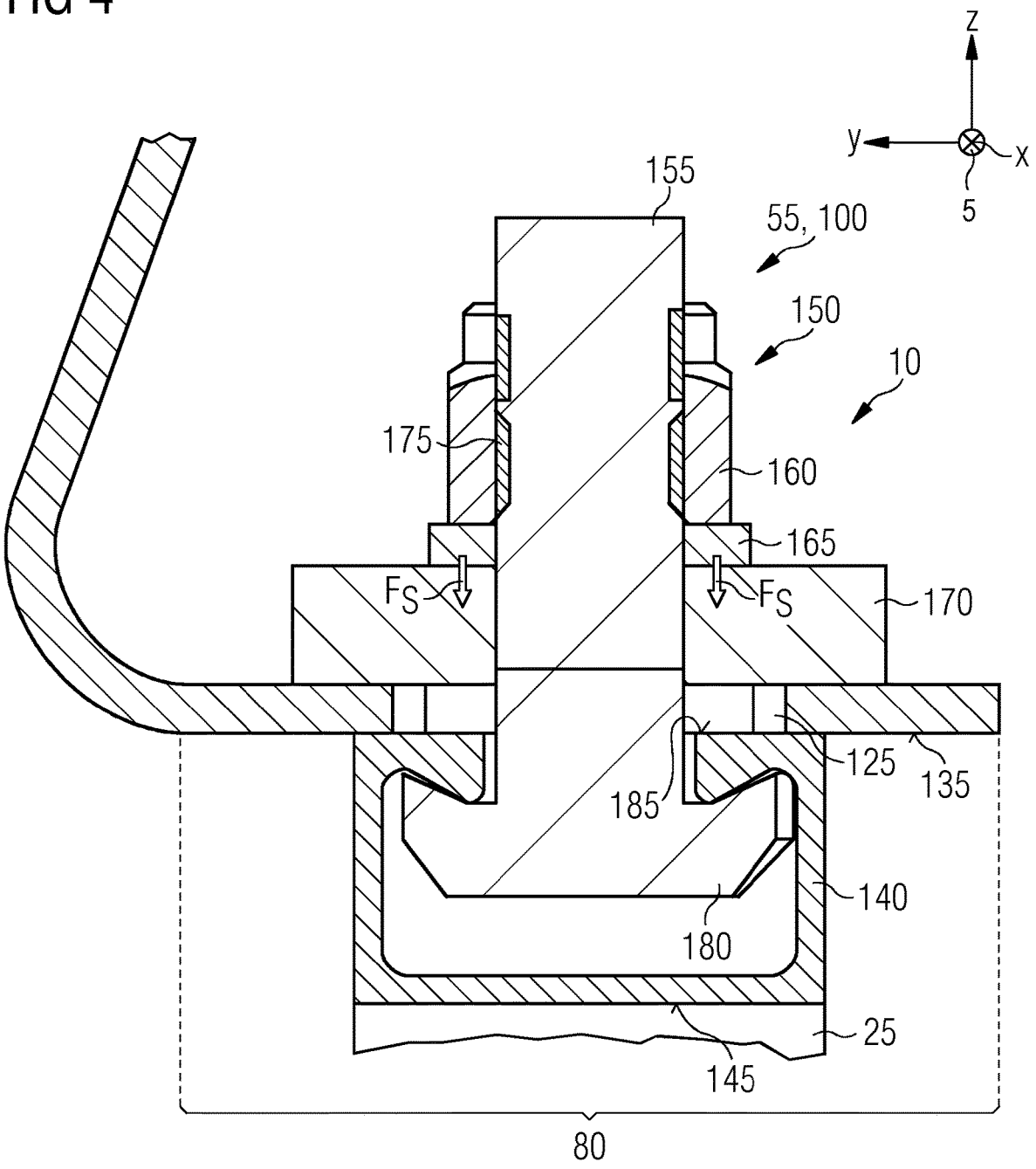
FIG. 4 shows a sectional view along the section plane A-A shown in FIG. 2 through a rail vehicle according to a second embodiment.

FIG. 4 shows a sectional view through a rail vehicle 10 according to a second embodiment along the section plane A-A shown in FIG. 2.

The rail vehicle 10 is configured so as to be substantially identical to the rail vehicle 10 explained in FIGS. 1 to 3. Deviating therefrom, the first fastening unit 55 has a first fastening rail 140. The first fastening rail 140 in an exemplary manner has a C-shaped profile. A lower side 145 of the first fastening rail 140 is connected to the car body 25.

The fixed bearing 100 has a first force-fitting connection 150. It is particularly advantageous when the first force-fitting connection 150 is configured as a screw connection. In the embodiment, the first force-fitting connection 150 has a first screw 155, a first screw nut 160, a first contact pressure disk 165, and a first sleeve 170.

The first screw 155 on one side has a first threaded portion 175, and opposite the first threaded portion 175 has a first screw head 180. The first screw head 180 engages in the first fastening rail 140. Furthermore, the first screw 155 penetrates the first through opening 125 in the first fastening portion 80. The first through opening 125 in FIG. 4 in comparison with FIG. 3 is configured so as to be wider in the y-direction in terms of the first screw 155, such that a gap is provided between a contour of the first through opening 125 and an external circumferential face of the first screw 155, said gap avoiding shear stress on the first screw 155. The first sleeve 170 is disposed on the first fastening portion 80 on a side that is opposite the first screw head 180. The first contact pressure disk 165 is disposed between the first sleeve 170 and the first screw nut 160 which is screwed onto the first threaded portion 175. The first contact pressure disk 165 serves for transmitting a tensioning force $F_s$ from the first screw 155 to the first sleeve 170, wherein the first sleeve 170 presses the lower side 135 of the first fastening portion 80 against an upper side 185 of the first fastening rail 140.

It is particularly advantageous when the first force-fitting connection 150 is pretensioned such that a friction-fitting connection is configured between the lower side 135 of the first fastening portion 80 and the upper side 185 of the first fastening rail 140, so that the position of the first fastening portion 80 is reliably established in all three spatial directions on account of the fixed bearing 100.

Figure 5:
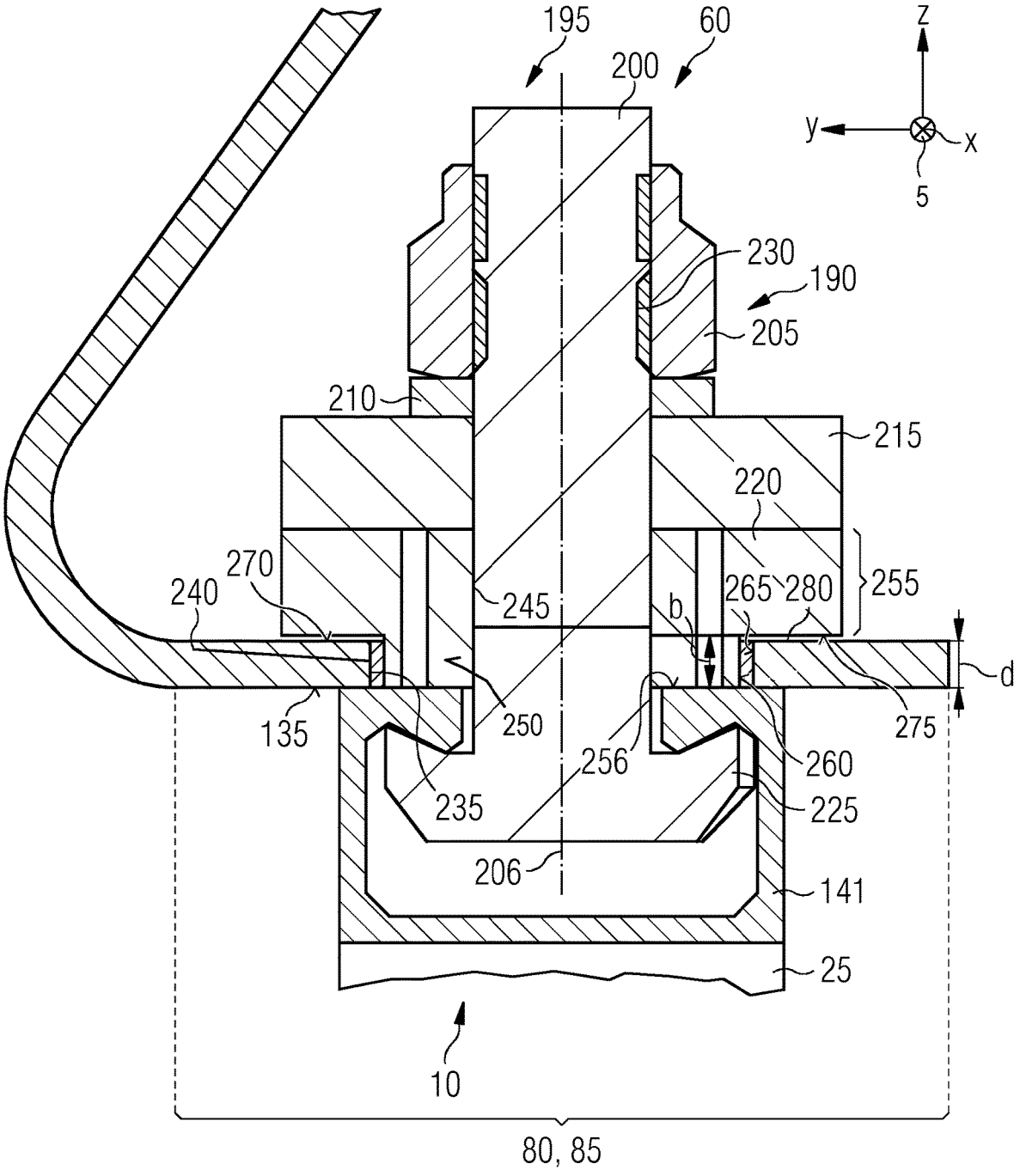
FIG. 5 shows a sectional view B-B along a section plane B-B shown in FIG. 2 through the second fastening unit.

FIG. 5 shows a sectional view through the second fastening unit 60 along a section plane B-B shown in FIG. 2.

The second fastening unit 60 has a floating bearing 190. The floating bearing 190 has a second screw connection which is configured as a second force-fitting connection 195. The second force-fitting connection 195 has a second screw 200, a second screw nut 205, a second contact pressure disk 210, a second sleeve 215, and a fastening sleeve 220. The second screw 220 can be configured so as to be identical to the first screw 155 explained in FIG. 4. The second screw 200 with a second screw head 225 engages in the second fastening rail 141. The second fastening rail 141 can either be configured continuously and in one piece and materially integral with the first fastening rail 140 and be disposed on the upper side of the car body 25, or be disposed so as to be spaced apart from the first fastening rail 140 in the vehicle longitudinal direction 15.

The second screw nut 205 is screwed onto a second threaded portion 230 of the second screw 200, said second threaded portion 230 in the z-direction being disposed so as to be opposite the second screw head 225.

The second screw 200 penetrates the second contact pressure disk 210, on a side facing the second fastening rail 141 the second screw nut 205 bears on the second contact pressure disk 210. The second contact pressure disk 210 on a side facing away from the second screw nut 205 bears on the second sleeve 215. The second sleeve 215 in terms of a screw axis 206 of the second screw 200 is configured so as to be wider than the second contact pressure disk 210. The second sleeve 215 here in is configured so as to be cylindrical about the screw axis 206.

The second sleeve 215 on a side of the second sleeve 215 that faces away from the second screw nut 205 bears on the fastening sleeve 220 at the face side.

The fastening portion 80, 85 has a second through opening 235. The second through opening 235 has a through opening contour 240. The through opening contour 240 can be configured, for example, so as to run in a circular manner about the screw axis 206.

The fastening sleeve 220 has a third through opening 245 as well as a first sleeve portion 250 and a second sleeve portion 255 which in terms of the screw axis 206 is axially contiguous to the first sleeve portion 250. The second sleeve portion 255 on the radially outer side in terms of the screw axis 206 has a larger radial extent than the first sleeve portion 250. In the axial direction, an axial width b of the first sleeve portion 250 is larger than a thickness d of the first fastening portion 80.

The third through opening 245 in the axial direction extends across the entire axial width of the fastening sleeve 220. In the assembled state of the floating bearing 190, the second screw 200 penetrates the second contact pressure disk 210 and the second sleeve 215 as well as the third through opening 245.

On account of the staged design embodiment of the first sleeve portion 250 and of the second sleeve portion 255, the first sleeve portion 250 exclusively penetrates the second through opening 235, wherein the second sleeve portion 255 is disposed outside the second through opening 235. The first sleeve portion 250 herein at the face side bears on an upper side 256 of the second fastening rail 141. The through opening contour 240 herein, in relation to the external circumferential face 260 of the first sleeve portion 250 of the fastening sleeve 220, can be configured in such a manner that a radial gap 265 is provided between the external circumferential face 260 of the first sleeve portion 250 and the through opening contour 240.

In the assembled state, the lower side 135 of the fastening portion 80, 85 bears on the upper side 256 of the second fastening rail 141. On account of the larger width b of the first sleeve portion 250 in relation to the thickness d of the first fastening portion 80, an axial gap 280 is disposed between an upper side 270 of the fastening portion 80, 85, and a face side 275 of the second sleeve portion 255, said face side 275 facing the upper side 270 of the first fastening portion 80. On account of the axial gap 280 it is ensured that the fastening portion 80, 85, in the event of a thermal expansion of the roof 20, on the floating bearing 190 can move in relation to the second force-fitting connection 195. The movement takes place substantially in the vehicle longitudinal direction 15.

On account of the first sleeve portion 250 at the face side bearing on the upper side 185 of the first fastening rail 140 it is furthermore ensured that the axial gap 280 is maintained, and no friction-fitting connection between the upper side 256 of the fastening rail 140 and the fastening portion 80, 85, and/or between the upper side 270 of the fastening portion 80, 85 and the second sleeve portion 255, is erroneously configured, for example when tightening the second screw nut 205 beyond a prescribed torque.

Figure 6:
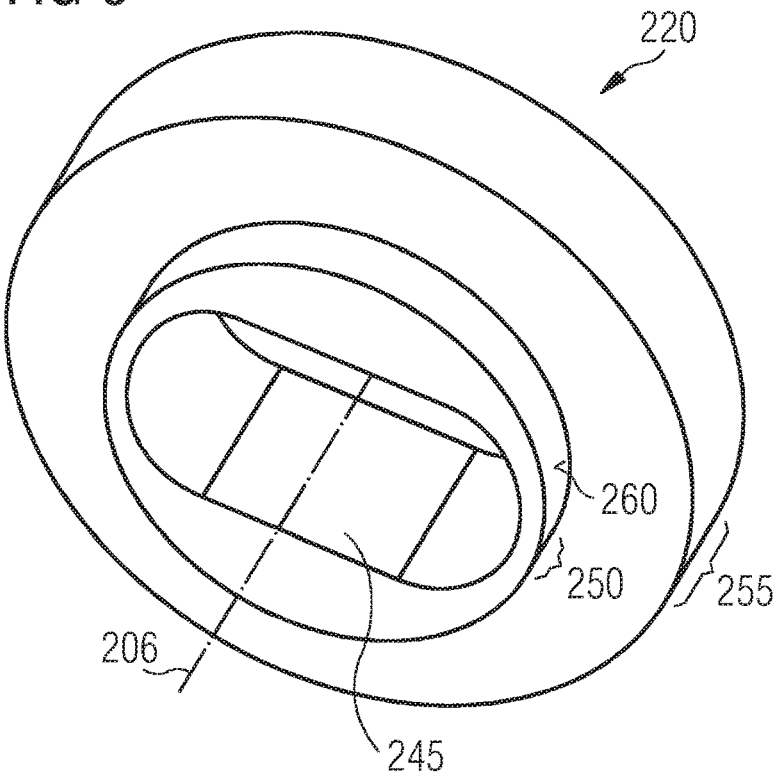
FIG. 6 shows a perspective illustration of the fastening sleeve.

FIG. 6 shows a perspective illustration of the fastening sleeve 220.

The third through opening 245 in the embodiment is configured in the shape of an elongate hole, wherein the third through opening 245 has a shorter extent and a wider extent. The wider extent extends transversely to the vehicle longitudinal direction 15, and in the embodiment extends in the y-direction, as shown in FIG. 5.

Figure 7:
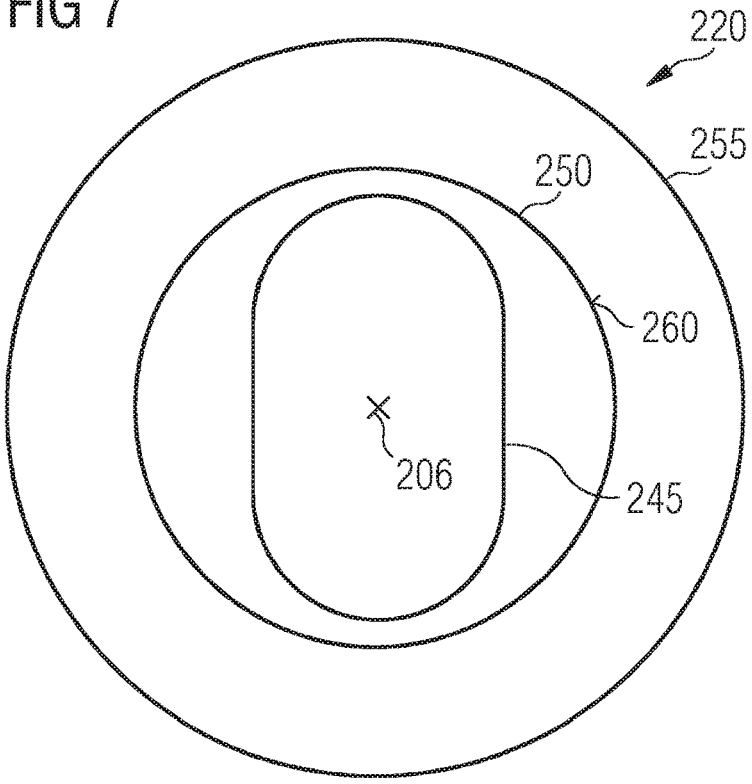
FIG. 7 shows a plan view of the fastening sleeve.

FIG. 7 shows a plan view of the fastening sleeve 220.

The first sleeve portion 250 and the second sleeve portion 255 are configured so as to be concentric. Furthermore, the third through opening 245 is disposed so as to be centric in relation to the first sleeve portion 250 and centric in relation to the second sleeve portion 255.

On account of the disposal of the first fastening portion 80 between the upper side 185 of the fastening rail 140 and the face side 275 of the second sleeve portion 255, a position of the first fastening portion 80 in relation to the car body 25 is also established in the z-direction, wherein the fastening portion 80, 85 on the floating bearing 190 can however move in the longitudinal direction in relation to the car body 25. On account thereof, a length compensation between the dissimilar materials of the roof 20 and the car body 25 is ensured in the event of a thermal expansion or in the event of a thermal contraction of the roof 20. Furthermore, the choice in terms of material is more liberal than in the case of conventional fastenings of roofs, since the thermal expansion behavior herein can be left out of the equation in the selection of materials.

Figure 8:
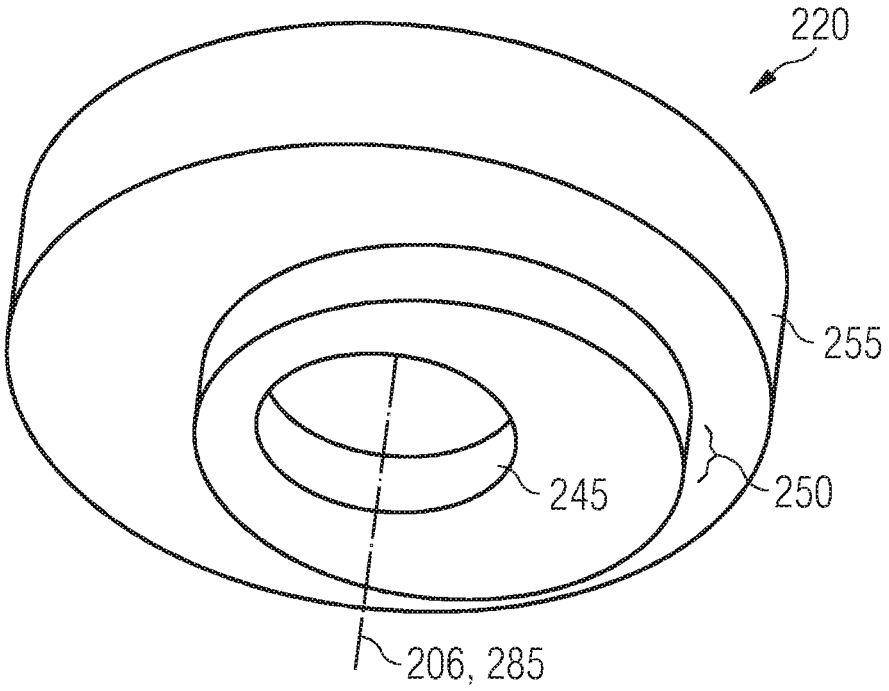
FIG. 8 shows a perspective illustration of a variant of the fastening sleeve shown in FIGS. 5 to 7.
Figure 9:
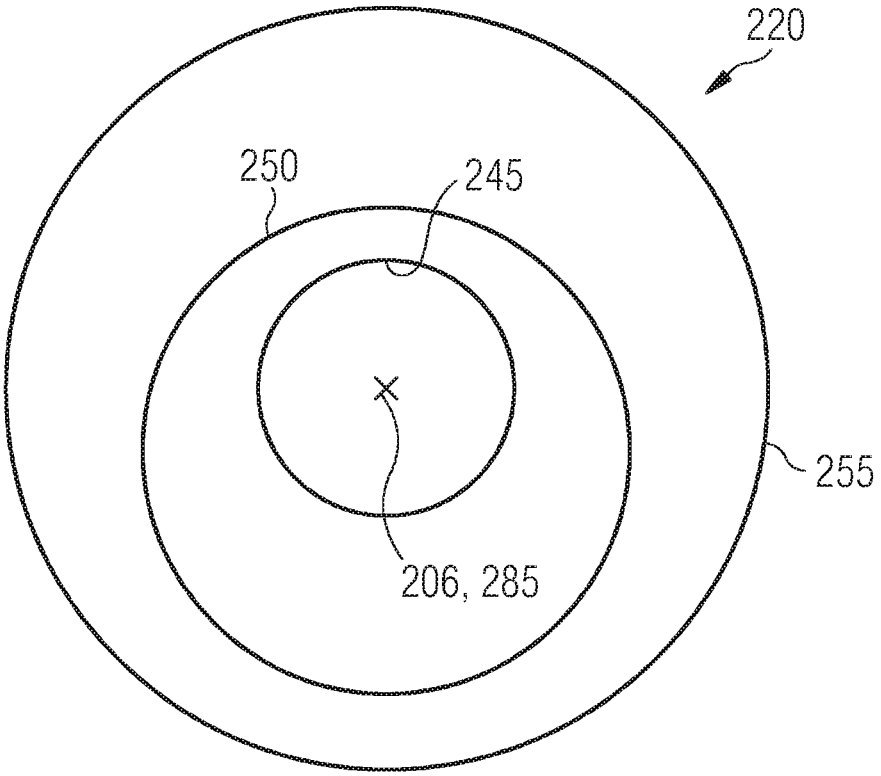
FIG. 9 shows a plan view of the fastening sleeve shown in FIG. 8.

FIG. 8 shows a perspective illustration of a variant of the fastening sleeve 220 shown in FIGS. 5 to 7. FIG. 9 shows a plan view of the fastening sleeve 220 shown in FIG. 8.

The third through opening 245 in the embodiment is disposed so as to run in a circular manner about a bore axis 285. The bore axis 285 of the third through opening 245 and the screw axis 206 overlap herein. The first sleeve portion 250 is disposed so as to be eccentric in relation to the bore axis 285, while the second sleeve portion 255 by contrast is disposed so as to be centric in relation to the bore axis 285.

On account of the eccentric disposal, a compensation of tolerances in relation to the second fastening units 60, disposed opposite in the second plane, and the roof 20 can be provided on account of the rotation of the fastening sleeve 220 about the screw axis 206, while the floating bearing 190 by contrast simultaneously reliably ensures a mounting of the roof 20 enabling the latter to move in the vehicle longitudinal direction 15 in relation to the car body 25.

Figure 10:
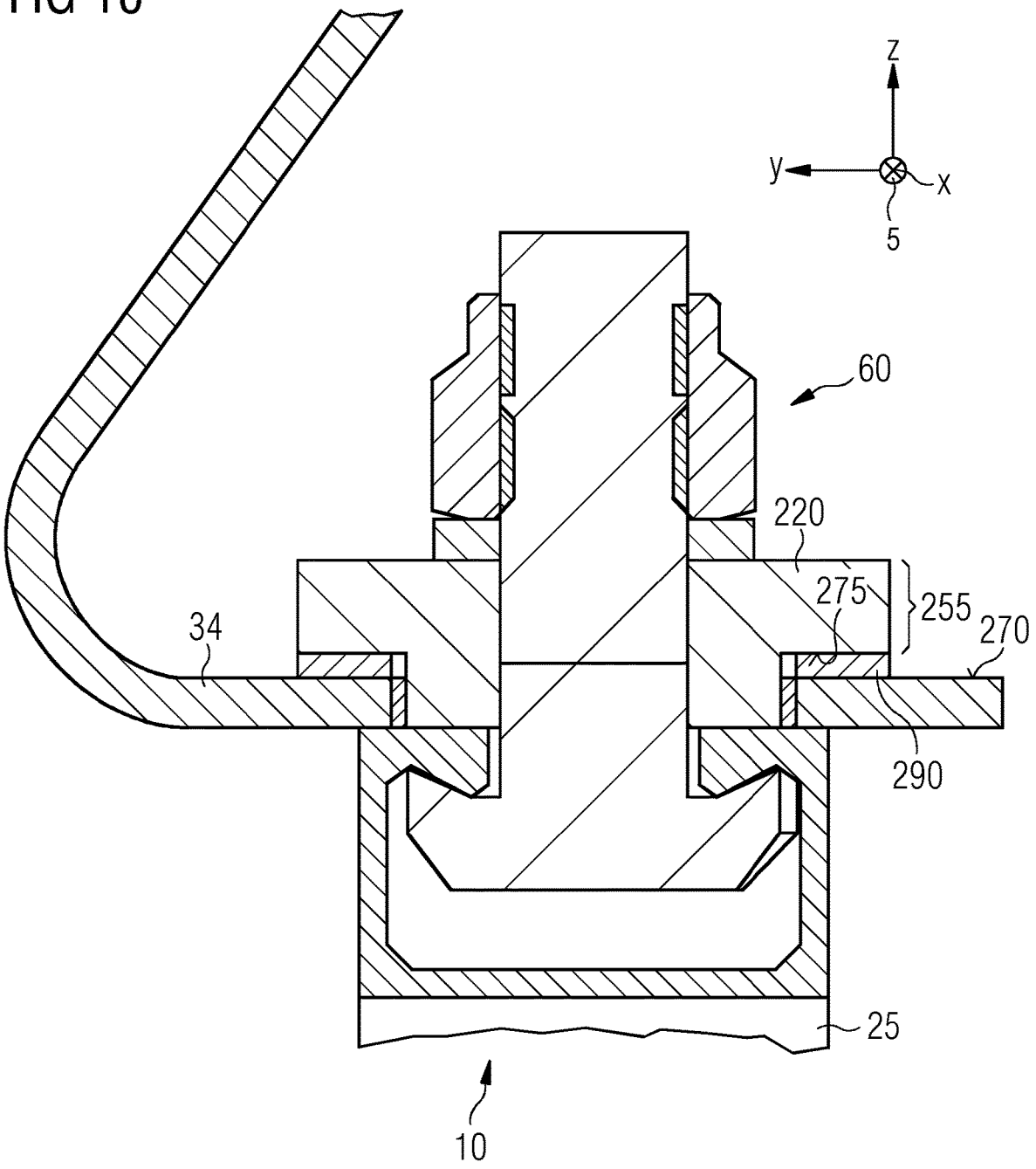
FIG. 10 shows a sectional view along a section plane B-B shown in FIG. 2 through a variant of the fastening unit shown in FIG. 5.

FIG. 10 shows a sectional view through a variant of the fastening unit 60 shown in FIG. 5, along a section plane B-B shown in FIG. 2.

The fastening unit 60 is configured so as to be substantially identical to the fastening unit 60 shown in FIG. 5. An elastic element 290 is additionally disposed between the face side 275 of the second sleeve portion 255 and the upper side 270 of the fastening portion 80, 85 of the roof segment 34. The elastic element 290 herein is configured so as to be disk-shaped. The elastic element 290 encompasses circumferentially the first sleeve portion 250 of the fastening sleeve 220. The elastic element 290 preferably comprises one of the following materials: rubber, silicone, natural rubber. A position of the roof segment 34 in all spatial directions is reliably established on account of the elastic element 290, however a mobility of the roof segment 34 in the vehicle longitudinal direction 15 relative to the car body 25 is simultaneously ensured such that a reliable compensation of length between the roof segment 34 and the car body 25 is ensured, in particular when dissimilar materials are used for the roof segment 34 and the car body 25.

The invention claimed is:

1. A rail vehicle, comprising:

a roof having a roof fastening portion with a roof fastening portion thickness;

a car body; and a fastening installation having at least one first fastening unit and at least one second fastening unit, said first fastening unit and said second fastening unit are disposed so as to be mutually offset and configured so as to fasten said roof to said car body, wherein said first fastening unit having a fixed bearing configured for preventing a movement of said roof relative to said car body, wherein said second fastening unit having a floating bearing, wherein said floating bearing configured for permitting a movement of said roof in a vehicle longitudinal direction of the rail vehicle, and for preventing a movement of said roof perpendicular to the vehicle longitudinal direction, said floating bearing having a fastening sleeve, said fastening sleeve having a first sleeve portion, a second sleeve portion and a through opening formed therein for a screw, said second sleeve portion having a larger radial extent than said first sleeve portion, said first sleeve portion having an axial width being greater than said roof fastening portion thickness.

2. A rail vehicle, comprising:

a roof having at least one roof segment;

a car body having a first car body portion and a second car body portion; and a fastening installation having at least one first fastening unit and at least one second fastening unit, said first fastening unit and said second fastening unit being disposed to be mutually offset and configured for fastening said roof to said car body, said first fastening unit having a fixed bearing configured for preventing a movement of said roof relative to said car body, said second fastening unit having a floating bearing, said floating bearing being configured for permitting a movement of said roof in a vehicle longitudinal direction of the rail vehicle and for preventing a movement of said roof perpendicular to the vehicle longitudinal direction;

said at least one roof segment in the vehicle longitudinal direction covering a sub-region of the rail vehicle, and in a transverse direction extending across an entire vehicle width of the rail vehicle;

said first car body portion and said second car body portion extending parallel with the vehicle longitudinal direction, and disposed mutually offset in the transverse direction;

said at least one first fastening unit being one of a plurality of first fastening units;

said at least one roof segment being connected to said first car body portion exclusively by way of only one of said first fastening units, and being connected to said second car body portion exclusively by way of only one further one of said first fastening units; and said first fastening units being configured so as to be mutually identical.

3. The rail vehicle according to claim 2, wherein:

said fastening installation has a first row and a second row;

each of said first and second rows has in each case a plurality of second fastening units and exclusively precisely said first fastening unit; and said first row fastens said at least one roof segment to said first car body portion, and said second row fastens said at least one roof segment to said second car body portion.

4. The rail vehicle according to claim 3, wherein:

said first fastening units are in each case disposed in a first plane;

the first plane is aligned so as to be perpendicular to the vehicle longitudinal direction of the rail vehicle;

said second fastening units are in each case disposed in a second plane which is aligned so as to be perpendicular to the vehicle longitudinal direction of the rail vehicle; and the first plane in relation to the second plane is disposed so as to be offset in the vehicle longitudinal direction.

5. A rail vehicle, comprising:

a roof having a first through opening formed therein;

a car body;

a fastening installation having at least one first fastening unit and at least one second fastening unit, said first fastening unit and said second fastening unit being disposed to be mutually offset and configured for fastening said roof to said car body, said first fastening unit having a fixed bearing configured for preventing a movement of said roof relative to said car body, said second fastening unit having a floating bearing, said floating bearing being configured for permitting a movement of said roof in a vehicle longitudinal direction of the rail vehicle and for preventing a movement of said roof perpendicular to the vehicle longitudinal direction;

said fixed bearing having a connecting portion and a fastening element with a penetrating portion configured in a manner of a stud and having an external circumferential face;

said connecting portion being connected to said penetrating portion;

said connecting portion, on a side that faces away from said penetrating portion, being connected to said car body;

said penetrating portion penetrating said first through opening; and said first through opening and said external circumferential face of said penetrating portion being configured without a mutual gap.

6. The rail vehicle according to claim 1, wherein:
said fixed bearing has a force-fitting connection and a first fastening rail;
said first fastening rail has a lower side connected to said car body; and
said force-fitting connection engages in portions in said first fastening rail and pushes said roof against said first fastening rail.

7. The rail vehicle according to claim 2, wherein:
said floating bearing has a further force-fitting connection with a screw nut and a screw;
said roof has a second through opening formed therein;
said screw at one side is coupled to said car body, and at an opposite side said screw nut is screwed onto said screw about a screw axis of said screw;
said fastening sleeve is disposed between said screw nut and said car body, and has a first sleeve portion, a second sleeve portion which in terms of the screw axis is axially contiguous to said first sleeve portion, and a third through opening formed therein;
said second sleeve portion in terms of the screw axis has a larger radial extent than said first sleeve portion;
said screw penetrates said third through opening, and said first sleeve portion engages in said second through opening; and
said second sleeve portion is disposed between said screw nut and said roof and, by way of said roof impacting on said second sleeve portion, prevents a movement of said roof away from said car body.

8. The rail vehicle according to claim 7, wherein:
said third through opening is disposed so as be centric in relation to said second sleeve portion; and
said first sleeve portion is disposed so as to be eccentric in relation to said second sleeve portion.

9. The rail vehicle according to claim 7, wherein:
said third through opening is configured in a manner of an elongate hole; and
said third through opening in a direction of wider extent thereof extends transversely to the vehicle longitudinal direction.

10. The rail vehicle according to claim 7, wherein:
said second fastening unit has a second fastening rail;
said second fastening rail by way of a lower side is fastened to said car body on an upper side;
said screw has a screw head which engages in said second fastening rail;
said fastening sleeve is braced between said second fastening rail and said screw nut, and said first sleeve portion at a face side bears on an upper side of said second fastening rail; and
said second sleeve portion by way of a sleeve lower side holds said roof to said upper side of said second fastening rail.

11. The rail vehicle according to claim 10, wherein disposed between said roof and a face side of said second sleeve portion is an axial gap.

12. The rail vehicle according to claim 10,
further comprising an elastic element disposed between a face side of said second sleeve portion and said roof;
wherein said elastic element is configured so as to be disk-shaped and encompasses circumferentially said first sleeve portion; and
wherein said elastic element contains at least one material selected from the group consisting of: rubber, silicone, and natural rubber.

13. The rail vehicle according to claim 10, wherein:
said roof segment has a roof portion and a fastening portion;
said roof portion extends between said first and second car body portions and conjointly with said first and second car body portions delimits a vehicle interior space;
said fastening portion is disposed so as to be laterally contiguous to said roof portion and is connected to said roof portion and extends from the vehicle interior space away toward an outside;
said fastening portion is configured so as to be plate-shaped, and said second through opening is disposed in said fastening portion;
said fastening portion on a lower side bears on an upper side of said second fastening rail; and
said fastening portion is disposed between said upper side of said second fastening rail and said second sleeve portion.

14. The rail vehicle according to claim 6, wherein said force-fitting connection is a screw connection.

* * * * *